United States Patent [19]

Cantley et al.

[11] Patent Number: 4,901,938

[45] Date of Patent: Feb. 20, 1990

[54] ELECTRICAL CORD RETRACTOR

[76] Inventors: Donald G. Cantley, 45 Munson La., West Sayville, N.Y. 11796; Camie Alexander, 11 Norwood Ave., Glen Rock, N.J. 07452

[21] Appl. No.: 274,465

[22] Filed: Nov. 21, 1988

[51] Int. Cl.[4] ..... B65H 75/48

[52] U.S. Cl. ..... 242/107.1; 242/107.6

[58] Field of Search ..... 455/351; 242/107, 107.4 R, 242/107.6, 107.7, 47, 54 R, 77, 100, 100.1

[56] References Cited

U.S. PATENT DOCUMENTS

| | | | |
|---|---|---|---|
| 1,120,341 | 12/1914 | Smith | 242/107.6 |
| 1,687,371 | 10/1928 | Leeper | 455/351 |
| 2,172,043 | 9/1939 | Wolf | 242/107.6 |
| 2,429,675 | 10/1947 | Eypper | 242/100.1 |
| 2,591,438 | 4/1952 | Kinman et al. | 455/351 |
| 3,782,654 | 1/1974 | Kasa | 242/100.1 |
| 3,809,331 | 5/1974 | Gaul | 242/100.1 |

FOREIGN PATENT DOCUMENTS

| | | | |
|---|---|---|---|
| 2620924 | 11/1977 | Fed. Rep. of Germany | 242/107.7 |
| 2305292 | 8/1984 | Fed. Rep. of Germany | 242/100.1 |
| 640146 | 7/1928 | France | 242/107 |
| 1464060 | 11/1966 | France | 242/100.1 |
| 994143 | 5/1964 | United Kingdom | 242/100.1 |
| 1532997 | 11/1978 | United Kingdom | 242/107 |

*Primary Examiner*—Joseph J. Hail, III

*Attorney, Agent, or Firm*—Alan H. Levine

[57] ABSTRACT

An electrical cord retractor includes a closed hollow case separate from any apparatus with which an electrical cord will be used. Within the case is a winder, such as a rotatable spool, and the case is openable to permit an electrical cord to be wound upon the spool. The case wall has passageways through which an electrical cord can pass from the spool within the case to the exterior of the case, so that the cord can be connected to an apparatus independent of the case. The passageway may be slots which extend to a free edge of the case wall, so that after an electrical cord is wound on the spool, portions of the electrical cord extending from the spool can be inserted into the slots as the case is closed. The spool has a cord guide, in the form of a slot, extending from the external face of one of the spool flanges into the spool hub. A portion of an electrical cord is held stationary in the slot so that as the spool is rotated the remainder of the cord is wound upon the spool. The slot in the spool is arranged at an acute angle to the planes of the spool flanges, so that as the spool is rotated, the two portions of the cord extending from the slot will be wound on different sections of the spool hub. Within the case is a spring, constantly urging the spool to rotate in one direction, and a latch for releasably locking the spool against rotation.

9 Claims, 4 Drawing Sheets

FIG. 6
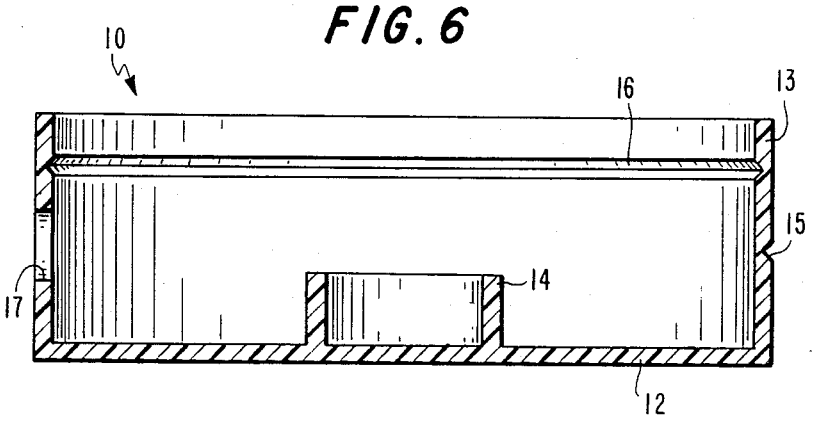
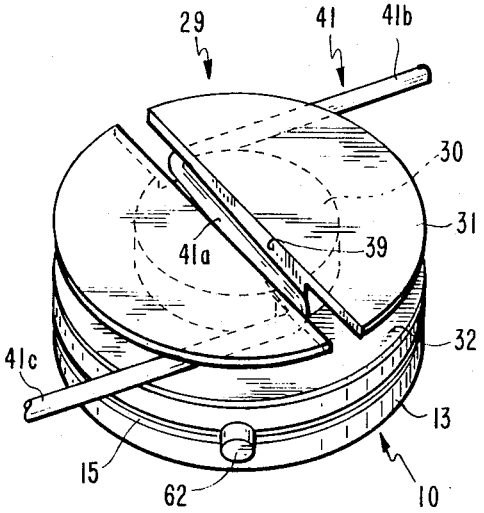
FIG. 7

ELECTRICAL CORD RETRACTOR

This invention relates to electrical cord retractors which wind-up and store electrical cords when they are not in use. The invention also relates to storage of an excess portion of the length of an electrical cord which is in use.

Electrical cords provided with many types of electrical appliances and apparatus are often longer than required in the particular environment in which the appliance or apparatus is used. For example, in the case of small, carry-about portable radios, the cord extending from the headset, or earphones, to the plug which connects to the radio, is usually longer than needed. As a result, the excess length of the cord hangs down when the radio is in use, and is liable to get caught on objects which the user passes. Also, when use of the radio is discontinued, the cord must be gathered together and placed in a pocket or purse, which if done hurriedly leaves a tangle of cord subject to becoming knotted.

Other examples of the problem are electrical lamp and appliance cords, which if too long sit in a jumbled mess on the floor between the lamp or appliance and the electrical outlet into which the cord is plugged. The problem is not limited to households, but also is found in laboratories and studios, where excess length of electrical cords are found heaped on the floor near electrical apparatus of all kinds.

Electrical cord retractors are known which are built into the pieces of apparatus with which they are used. Examples of such retractors are shown in U.S. Pat. Nos. 2,856,517 and 2,591,438. Independent cord retractors pre-assembled with lengths of electrical cord are also known, as indicated by U.S. Pat. Nos. 3,984,645 and 3,426,282.

In all these cases, the electrical cord and retractor are furnished together as a unit. They offer no way to assemble a pre-existing cord with the retractor.

It is, therefore, an object of the present invention to provide an electrical cord retractor useful with an existing electrical cord which forms part of an electrical appliance or apparatus already in the possession of the user.

It is another object of the invention to provide such a retractor capable of being opened, so that an electric cord forming part of an existing appliance or apparatus can be wound into the retractor, after which the retractor can be reclosed.

It is a further object of the invention to provide such a retractor incorporating a winder, capable of winding and storing an electrical cord when the latter is not in use, or of winding and storing an excess length of an electrical cord while the latter is in use.

Additional objects and features of the present invention will be apparent from the following description, in which reference is made to the accompanying drawings.

In the drawings:

FIG. 6 is a diametrical cross-sectional view through the base portion of the retractor case; and FIG. 7 is a perspective view of the retractor with the cover portion of the case removed.

Figure 1:
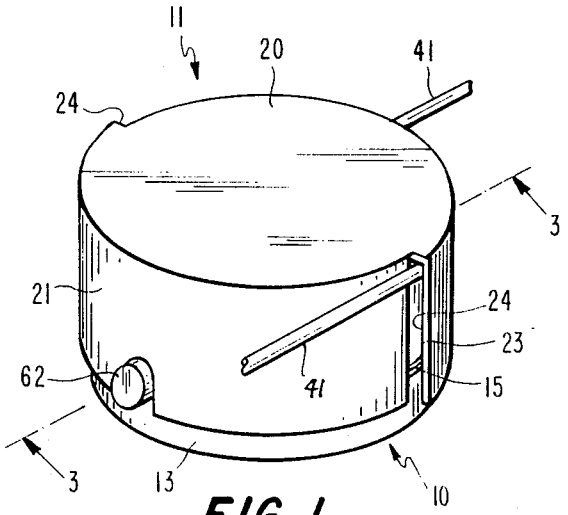
FIG. 1 is a perspective view of an electrical cord retractor in accordance with the present invention.
Figure 5:
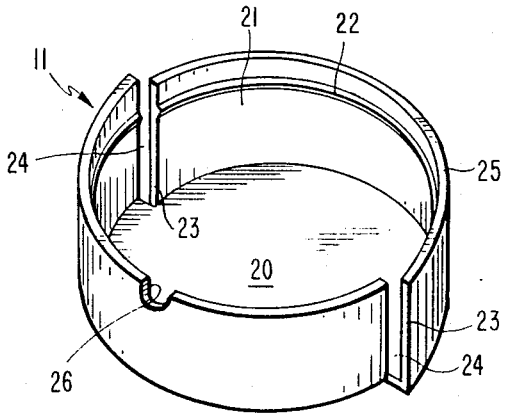
FIG. 5 is a perspective view of the cover portion of the retractor case, the cover being upside down.

The electrical cord retractor chosen to illustrate the present invention includes a case having a base portion 10 and a cover portion 11. Base 10 is a cup-like element (FIGS. 2, 3 and 6) having a flat bottom wall 12 and a cylindrical side wall 13 extending upwardly from the periphery of the bottom wall. Projecting upwardly from the center of bottom wall 12 is a short tubular boss 14 which serves as a bearing for the retractor winder or spool. Formed in the outer surface of sidewall 13 is an annular groove 15, and formed in the inner surface of sidewall 13 is another annular groove 16. A hole 17 extends completely through the thickness of sidewall 13.

Cover 11 is also a cup-like element (FIGS. 1–3) having a flat top wall 20 and generally cylindrical sidewall 21 extending downwardly from the periphery of the top wall. The inner surface of sidewall 21 presents a generally annular ridge 22 adapted to be accommodated by annular groove 15 in sidewall 13 of base 10. Thus, when cover 11 is closed over base 10 (FIG. 3), ridge 22 snaps into groove 15 to releasably hold the base and cover together so as to close the case. Base 10 and cover 11 are preferably made of molded plastic or thin metal so that they have sufficient resilience to allow for interconnection and release of ridge 22 and groove 15.

Sidewall 21 of cover 11 is discontinuous at two diametrically opposite points, and at those points the vertical edges 23 presented by the two semi-circular parts of sidewall 21 are out of alignment so as to define two vertical passageways or slots 24. Each slot 24 extends to, and is open at, the free edge 25 of sidewall 21. Slot 24 could alternately be located in sidewall 13 of base 10. The sidewall is also formed with a generally semi-circular notch 26 which extends to free edge 25 of the sidewall.

Figure 2:
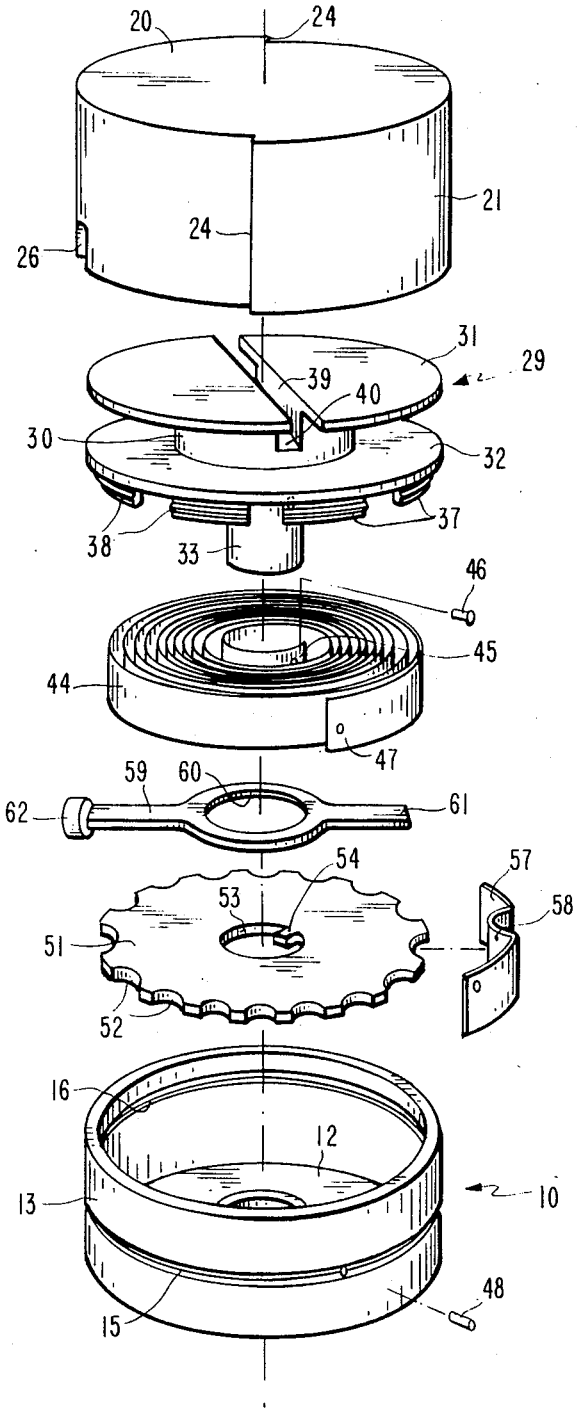
FIG. 2 is an exploded perspective view showing the various parts of the retractor.
Figure 3:
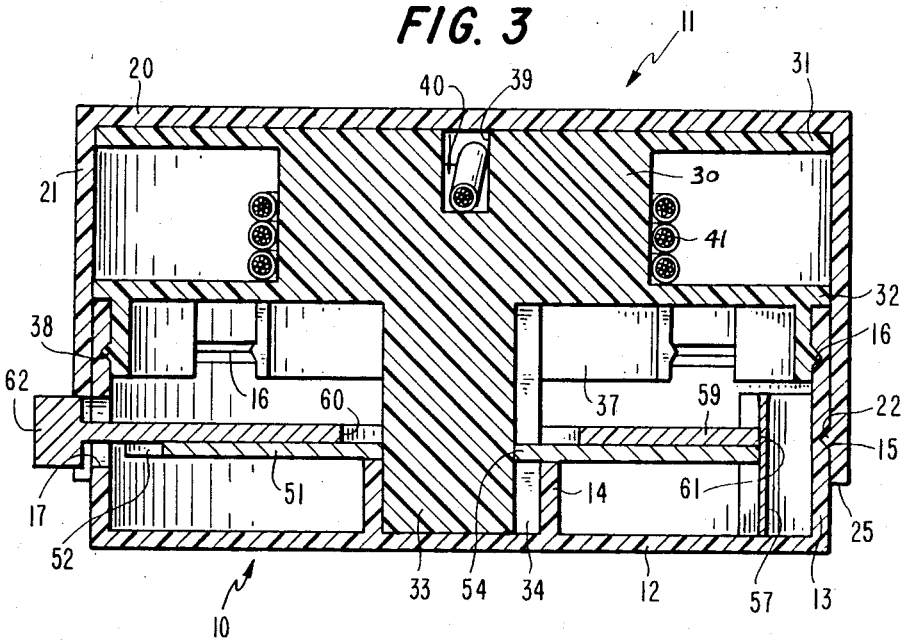
FIG. 3 is a diametrical cross-sectional view taken along line 3—3 of FIG. 1.

Within case 10,11 is a winding means, which in the present example is in the form of a spool 29 (FIGS. 2,3,4, and 7). The spool comprises a generally cylindrical hub 30 having radially-extending upper and lower flanges 31 and 32 at its upper and lower ends, respectively, Extending axially downwardly from the center of lower flange 32 is a shaft 33, the lower end of which is rotatably accommodated within boss 14 of the base portion 10 of the case. At one side, shaft 33 is formed with a longitudinal keyway 34 (FIG. 3).

Depending from lower flange 32 is a discontinuous circular wall defining a series of arcuate springy fingers 37. Projecting outwardly from each finger 37 is an arcuate ridge 38 adapted to be slidably accommodated within groove 16 formed in the inner surface of sidewall 13 of base 10. Spool 29 may be formed of molded plastic or other suitable material, so that when the spool is assembled with base 10, fingers 37 and sidewall 13 have sufficient resilience to permit ridges 38 to snap into groove 16. The cooperation between ridges 38 and groove 16 serves to interconnect spool 29 with base 10, and also insures stable rotation of spool 29 within the case.

Figure 4:
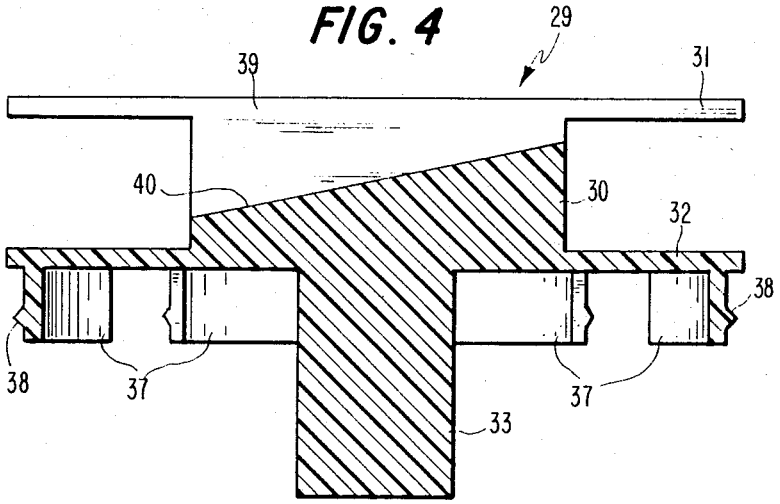
FIG. 4 is a diametrical cross-sectional view through the winder or spool, taken in a plane perpendicular to the plane of FIG. 3.

Spool 29 is formed with an electrical cord guide, in this example the guide being a slot 39 extending from the outer face of flange 31 into the spool hub 30. As best shown in FIG. 4, the base 40 of slot 39 lies at an acute angle to the planes containing flanges 31 and 32. The angled nature of slot base 40 encourages more even winding of an electrical cord around hub 30 of spool 29. When a portion 41*a* (FIG. 7) of an electrical cord 41 is laid into slot 39, portion 41*b* of the cord will be closer to flange 31 and portion 41*c* of the cord will be closer to flange 32, due to the angled nature of slot base 40. Thereafter, as spool 29 is rotated, portion 41*b* will be wound nearer the top of hub 30 and portion 41*c* of the cord will be wound closer to the bottom of hub 30, as a result of which the cord will be evenly wound along the entire length of hub 30. In contrast, if base 40 of slot 39 were parallel to flanges 31 and 32, upon rotation of spool 29, electrical cord 41 would build up in the plane of base 40 resulting in an uneven distribution of the cord along the length of hub 30.

A spiral spring 44 (FIG. 2) surrounds shaft 33 directly beneath lower flange 32. (For clarity, the spring has been omitted from FIG. 3.) The inner end 45 of the spring is fixed to shaft 33, such as by a pin 46. The outer end 47 of spring 44 is fixed to sidewall 13 of base 10, such as by a pin 48. It will be appreciated that as spool 29 is rotated in a counter-clockwise direction, in FIG. 2, spring 44 will be tensioned, so that when released the spring will automatically rotate spool 29 in a clockwise direction. Located directly above boss 14 is a toothed wheel 51 having a series of teeth around its periphery separated by indentations 52. Wheel 51 has a central hole 53 through which shaft 33 of spool 29 passes. A key 54 (FIGS. 2 and 3) projects into hole 53, and engages keyway 34 in shaft 33. As a result of the interengagement between key 54 and keyway 34, toothed wheel 51 and pulley 29 rotate together.

A detent 57 (FIGS. 2 and 3), which may be formed of a strip of springy metal, is fixed at one of its ends to the inner surface of base 10, conveniently by pin 48 which also anchors the outer end of spring 44. Intermediate its ends detent 57 presents a bulge 58 adapted to engage indentations 52 in toothed wheel 51. When bulge 58 of detent 57 engages in one of the indentations 52 of wheel 51, the detent prevents rotation of spool 29 under the influence of spring 44.

Directly above wheel 51 is an elongated actuator 59 (FIGS. 2 and 3). Between its ends, actuator 59 is provided with an eliptical opening 60 through which shaft 33 of spool 29 passes. The length of opening 60 is larger than the diameter of shaft 33, so that actuator 59 is permitted to slide longitudinally with respect to shaft 33 and case 10, 11. One end 61 of actuator 59 is located adjacent to bulge 58 of detent 57. The other end of actuator 59 extends through hole 17 in sidewall 13 of base 10 (FIG. 3), and carries a push button 62 slidably accommodated within notch 26 in sidewall 21 of cover 11 (FIGS. 1-3 and 7). When push button 62 is depressed, end 61 of actuator 59 pushes bulge 58 of detent 57 out of engagement with indentations 52, thereby releasing the latching function of detent 57 and wheel 51 so as to free spool 29 for rotation by spring 44. When push button 62 is released, the resilience of detent 57 returns actuator 59 to its initial position and permits bulge 58 to engage one of the indentations 52 to relatch the spool.

In use, the case is opened by removing cover 11 from base 10, thereby exposing spool 29. The spool is rotated counterclockwise in FIG. 2 in order to tighten and thereby tension spring 44. When the spring has been tightened to its maximum degree, the spool may be released and it will be latched in that position by cooperation of detent 57 and toothed wheel 51. The middle portion 41*a* (FIG. 7) of an electrical cord 41 is then laid into slot 39. Cover 11 may then be replaced on base 10, this action being permitted by the fact that slots 24 in sidewall 21 of cover 11 are open at the free edge 25 of the sidewall. As a result, the slots can be slipped over electrical cord portions 41*b* and 41*c*, respectively, so as to introduce those cord portions into the slots. After the case has been closed, push button 62 is depressed to disengage detent 57 and wheel 51, as a result of which spring 44 rotates spool 29 and causes electrical cord 41 to be wound on the spool hub 30 (FIG. 3). If desired, cord 41 could be wound on spool 29, as described above, prior to closing the case, after which cover 11 can be assembled with base 10.

When the retractor is used with an item such as a portable radio headset, the entire length of cord 41 can be wound on spool 29, leaving only the ear phones and plug exposed outside case 10, 11. When the headset is to be used, the plug is inserted into the radio, and just enough cord is unwound from the retractor to provide the length needed for the cord to reach from the radio to the user's ears. In this way, no excess cord will hang down and be subject to snagging or tangling.

Where the retractor is used with a piece of apparatus having an electrical cord plugged into the wall outlet, the retractor is applied to a point of the electrical cord between its ends, and activated to wind all excess cord within the retractor. In this way, only the length of cord needed to reach from the apparatus to the outlet is exposed. When the apparatus is to be moved, it is unplugged from the outlet, and the retractor is used to retract the entire length of apparatus cord, thereby completely storing the cord during the move.

If desired, the retractor case could be provided with a mounting means, most conveniently attached to the outer surface of bottom wall 12 of base 10. The mounting means could be a clip for attachment to the user's belt, or it could be a magnet or a hook and loop type fastener such as that sold under the trademark Velcro for attaching the retractor to the appliance or apparatus with which the retractor is used.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. An electrical cord retractor for use with an electrical cord already possessed by the user of the retractor, the retractor comprising:

a closed hollow case separate from any apparatus with which an electrical cord may be used, the closed case containing no electrical cord, winder means within the case rotatable with respect to the case, a spring within the case for constantly urging rotation of the winder means in one direction with respect to the case, latch means within the case for preventing rotation of the winder means when the spring is tensioned, the latch means including a toothed wheel rotatable with the winder means, and a detent of springy material adapted to engage the teeth of the wheel to prevent rotation thereof, manually-operable means for releasing the latch, said means including a single actuator element slidable with respect to the case, one end of the actuator being adjacent to the detent and the other end being exposed on the exterior of the case, the actuator being slidable in a direction transverse to the axis of rotation of the winder for engaging the detent and causing disengagement between the detent and the toothed wheel, the case including a base and a cover, means for releasably securing the cover to the base so that the case can be opened at will to permit an electrical cord to be wound upon the winder means, after which the case can be reclosed, and passageway means in the closed case through which an electrical cord can pass rom the winder means within the case to the exterior of the case for connection to an apparatus independent of the case, the passageway means being so formed that an electrical cord extending from the winder means can be inserted into the passageway means as the case is closed.

2. An electrical cord retractor as defined in claim 1 wherein one of the base and cover has a side wall surrounding the winder means, and the passageway means being formed in the side wall.

3. An electrical cord retractor as defined in claim 2 wherein the side wall has a free edge, and the passageway means is open at the free edge of the side wall to permit an electrical cord to be inserted laterally into the passageway means.

4. An electrical cord retractor as defined in claim 1 wherein the passageway means includes two separate slots in the case through which portions of an electrical cord adjacent to opposite ends of the cord can pass.

5. An electrical cord retractor as defined in claim 1 wherein the winder means has a cord guide for holding a short length of the cord stationary with respect to the winder means, so that as the winder means is rotated, the remainder of the cord is wound upon it.

6. An electrical cord retractor as defined in claim 5 wherein the winder means is a spool having a central hub and a flange at each end, the cord guide being a slot extending from the external face of one of the flanges into the spool hub.

7. An electrical cord retractor as defined in claim 6 wherein the flanges of the spool are in spaced apart parallel planes, and the base of the slot, from one end of the slot to the other, is at an acute angle to the planes of the flanges.

8. An electrical cord retractor as defined in claim 7 wherein both ends of the slot are in the region between the opposed faces of the flanges.

9. An electrical cord retractor as defined in claim 1 wherein the winder means includes an axial shaft, and the case has a bearing for rotatably accommodating the shaft.

* * * * *